US006200131B1

(12) United States Patent
Birch et al.

(10) Patent No.: US 6,200,131 B1
(45) Date of Patent: Mar. 13, 2001

(54) QUICK-CONNECT BURNER SET FOR OVENS

(75) Inventors: Richard Arnold Birch, Harpursville; Gary Warren Swingle, Binghamton, both of NY (US)

(73) Assignee: Recot, Inc., Pleasanton, CA (US)

( * ) Notice: Subject to any disclaimer, the term of this patent is extended or adjusted under 35 U.S.C. 154(b) by 0 days.

(21) Appl. No.: 09/515,273

(22) Filed: Feb. 29, 2000

(51) Int. Cl.[7] ..... F23D 11/36

(52) U.S. Cl. ..... 431/155; 431/251; 431/279; 431/354; 431/343; 239/450; 239/600

(58) Field of Search ..... 431/154, 155, 431/249, 251, 278, 279, 285, 359, 343, 174, 180; 126/39 N, 39 E; 239/282, 283, 450, 600

(56) References Cited

U.S. PATENT DOCUMENTS 1,038,965 * 9/1912 Roy ..... 239/283
2,894,570 * 7/1959 Downing ..... 431/154
3,363,845 * 1/1968 Pierce ..... 239/283
3,376,696 * 4/1968 Wells et al. ..... 239/282
3,588,303 * 6/1971 Karrer ..... 431/343
3,614,281 * 10/1971 Ramey ..... 431/343
3,874,839 * 4/1975 Riehl ..... 431/354
4,257,559 * 3/1981 Noren ..... 239/600

FOREIGN PATENT DOCUMENTS 0 560 419 * 9/1993 (EP) ..... 431/343
691219 * 5/1953 (GB) .

* cited by examiner

*Primary Examiner*—Ira S. Lazarus
*Assistant Examiner*—Josiah C. Cocks
(74) *Attorney, Agent, or Firm*—Colin P. Cahoon; Carstens, Yee & Cahoon

(57) ABSTRACT

A burner set adaptable to standard commercial ovens that allows for the quick change-out of burners. Sockets, threaded on one end and open on the other end, are installed in existing threaded couplings in communication with a burner manifold. Each socket has a burner guide attached to the open end and receives a burner in the open end. The burners are secured to the oven by a burner support with a pivotally attached gate.

18 Claims, 5 Drawing Sheets

QUICK-CONNECT BURNER SET FOR OVENS

BACKGROUND OF THE INVENTION

1. Technical Field

The present invention relates to quick-connect ribbon burners used in commercial ovens and, in particular, to a slip-fit connection between a burner and the burner manifold with the burners secured by a single gate and supporting tracks.

2. Description of Related Art

Ribbon burners are commonly used in commercial ovens, such as tortilla toasting ovens. These ribbon burners comprise small diameter, such as one inch, pipes that are threaded on one end and sealed on the opposite end. Down the length of all but small sections on either end of the pipe are one or more rows of orifices through which gas is discharged. The burners connect with a gas source by threading them into a threaded receiver attached to a burner manifold.

A typical prior art design of a burner set used in commercial ovens is illustrated by FIGS. 1*a* and 1*b*. FIG. 1*a* shows nine burners 102 installed and connected to a burner manifold 104. This nine-burner arrangement is fairly typical, although ovens can be designed with variable numbers of burners. Pressurized gas forced through the rows of orifices on each individual burner 102 is ignited, thereby providing the heat source for the particular oven.

As shown in FIG. 1*b*, each burner 102 is supported at an open end 103 by threading it into a female coupling 106, which coupling 106 in turn is welded to or otherwise permanently affixed to the manifold 104. Gas is, therefore, passed from the burner manifold 104, through the female coupling 106, and into the burner 102. Support at the closed end 101 of the burner 102 is provided by a support bracket 108.

Individual burners 102 occasionally need removing due to quality issues, typically involving non-uniform heat distribution across the length of the burner 102. Unfortunately, the burners 102 warp and distort due to the constant exposure to high temperatures. Further, constant exposure to the gas used, typically natural gas, can cause corrosion of the metal components of the burner 102 and other components of the burner assembly. This can frequently make the removal of an individual burner 102 a difficult task.

In order to remove a burner 102, the burner 102 must be twisted until disengaged from the threaded female coupling 106. The connection between the threaded end 103 of the burner 102 and the coupling 106 frequently seizes because of heat and corrosion, making disengagement between the burner 102 and the coupling 106 quite difficult. This adds to the removal time for each burner 102 and can result in damage to either the burner 102 or the coupling 106 as the operator tries to mechanically force the disengagement. Further, since it is sometimes necessary to apply high levels of torque to remove the burners 102, it is advisable to allow the entire oven and burner assembly time to cool down before attempting a burner 102 change-out. A cool down period adds to the time required to remove or inspect individual burners 102.

The burner assemblies illustrated in FIGS. 1*a* and 1*b* are fairly typical of toasting ovens used in the food processing industry, such as Casa Hererra Model No. MACH IV and EFM Model No. TCOBPQ 24,170. Removal for inspection of an entire row of nine burners 102 on these typical toasting ovens results in approximately two hours of down time and requires two operators to safely and effectively remove the burners 102. For near continuous use of these ovens, it is preferable that such inspections occur on a regular basis, such as every three to four weeks. Further, it is occasionally necessary to remove a single burner 102 when the burner fails to provide an even heat source across the length of the burner 102. Even when the oven and burner set is not allowed to cool, removing a single burner 102 can take anywhere from five minutes to an hour, depending on how easily the burner 102 can be removed from the manifold coupling 106. The time required to remove burners results in lost productivity for the product line and increased labor costs.

Consequently, a need exists for a burner set that allows for a quick and safe removal and installation of burners. This burner set should provide a sealed communication with the burner manifold, adequate support for the entire burner, and provisions for maintaining a tight fit for all components that compensates for the deformation of individual burners over time. Such apparatus should allow for change-out of an entire burner set in a matter of minutes, as opposed to hours.

SUMMARY OF THE INVENTION

The proposed invention comprises quick-change sockets that are threaded on one end to attach to the original coupling of an oven's burner manifold. The quick-change sockets comprise a smooth opening on the opposite end for receiving a non-threaded burner. Further, each quick-change socket incorporates a burner guide or track that provides horizontal support for installed burners. The burners are secured in the quick-change sockets by a gate pivotally attached to a burner support.

Once a quick-change socket has been attached to the oven's gas manifold, a burner is slid into the open end of the coupling for a slip-fit connection. A gate is then closed over the closed end of the burner. The gate can also incorporate a bolt tapped through the gate that can be tightened onto the closed end of the burner, thereby providing a pressure seat of the burner in the socket. As long as the gate is open, however, the door of the burner cannot be closed. This feature insures that operation of the oven is dependent on completion of the burner installation.

The invention allows for the inspection and change-out of several burners in a matter of minutes, as opposed to the hours needed with prior art designs. Further, since the quick-change socket remains affixed to the manifold, the present invention eliminates the possibility of damaging burners or the manifold itself due to forcing the corroded threaded connections between the two.

The invention greatly reduces the time required to keep an oven off line when replacing or inspecting burners, thus increasing line productivity. Further, fewer man hours are required to change out burners using the present invention.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
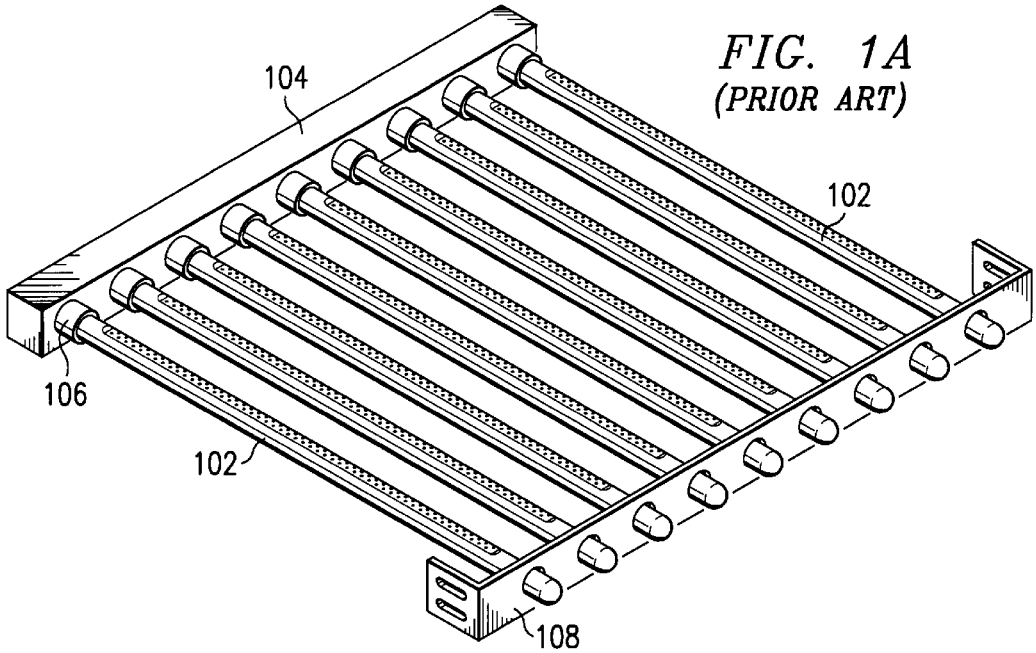
FIG. 1A (PRIOR ART)
FIG. 1*a* is a perspective representation of a prior art burner set.
Figure 1B:
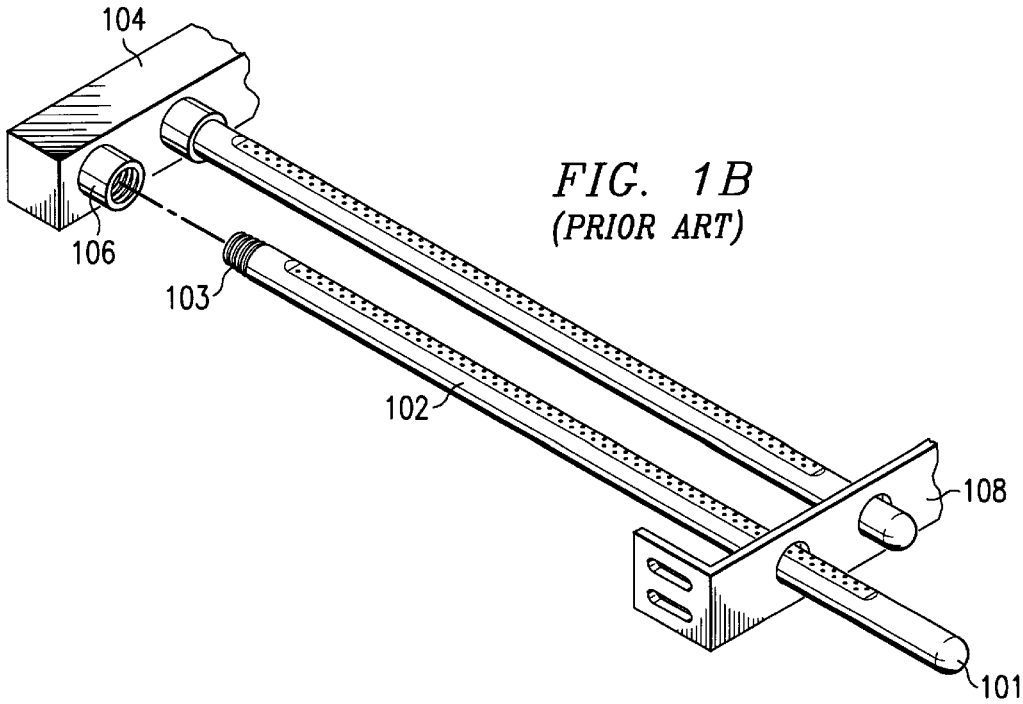
FIG. 1B (PRIOR ART)
FIG. 1*b* is a partial perspective view of the prior art burner set of FIG. 1*a* with one burner disengaged from the burner manifold.
Figure 2:
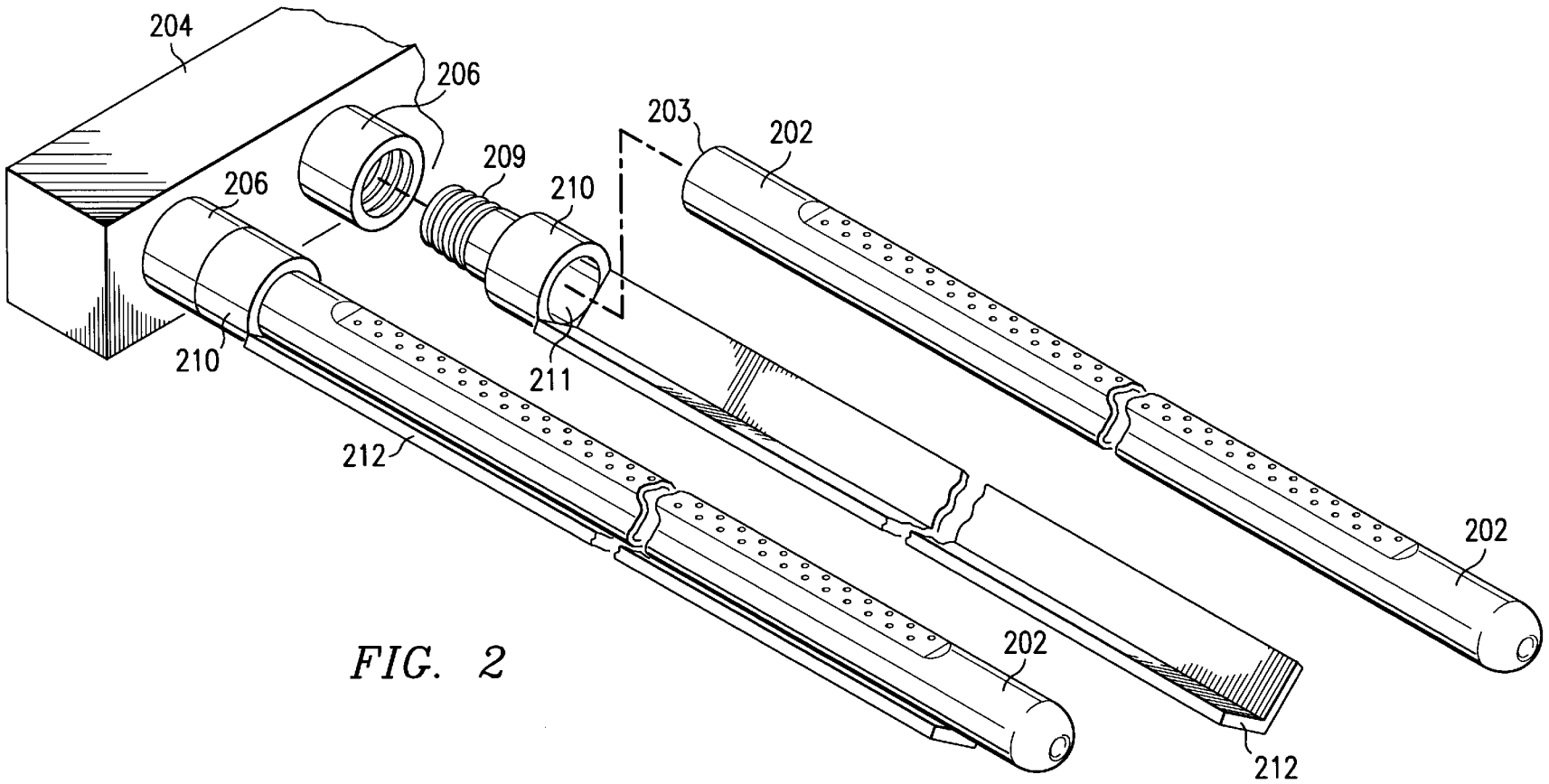
FIG. 2 is a partial perspective view showing two quick-change sockets with burner guides and one burner in suspension of one embodiment of the present invention.

FIG. 2 is a partial view of the present invention showing two burners 202 and two sockets 210. Also shown is a portion of an existing or prior art manifold 204 and two associated threaded couplings 206. Each socket 210 of the present invention comprises a threaded end 209 and an open end 211. The threaded end 209 is threaded into a female coupling 206, just as the threaded end of a prior art burner is threaded into an adjacent coupling. Once the socket 210 is installed in the manifold coupling 206, the socket 210 can receive a burner 202. Unlike prior art burners, the burner 202 of the present invention is not threaded at its open end 203. Consequently, the burner 202 abuts in the socket 210. The sealing of this slip-fit connection between the burner 202 and the socket 210 can be assisted by applying an anti-seize compound to discourage corrosion of the connection. The socket 210 is preferably stainless steel, with 316 stainless steel having been used as a suitable material. The burners 202 can be prior art burners with the threaded ends cut off.

The threaded connection between each socket 210 and its adjacent threaded coupling 206 is intended to be fairly permanent. Once all of the sockets 210 have been installed, the installation and removal of a burner 202 in an individual socket 210 merely requires sliding the opened end 203 of the burner into or out of the receiving end 211 of the socket 210. By eliminating the need to disengage a threaded connection between the burner and the manifold, the present invention greatly reduces the amount of time required to remove a burner set or to remove an individual burner. The ease of removal due to the slip-fit connection allows for the change-out of one or more burners 202 without first necessitating the cooling of the oven, which further saves time.

The embodiment illustrated in FIG. 2 further provides for a track or burner guide 212 that provides horizontal support along the length of an installed burner 202 and provides a guide for installing the burners 202 in adjacent sockets 210. The burner guides 212 also provide a useful means for holding each burner 202 in place until such time as it is further secured, as will be described below. The burner guide 212 shown in the embodiment illustrated in FIG. 2 comprises a metal angle or trough welded to the open end 211 of the socket 210. Alternative embodiments can incorporate other means for providing horizontal support of the burner 202, such as a burner guide constructed in a semi-circular shape or a flat surface burner guide. An alternative embodiment of the present invention could also comprise burner guides that are shorter in length. Another alternative embodiment does not require burner guides at all, depending on the length of the burners in question and other characteristics of the oven.

Figure 3A:
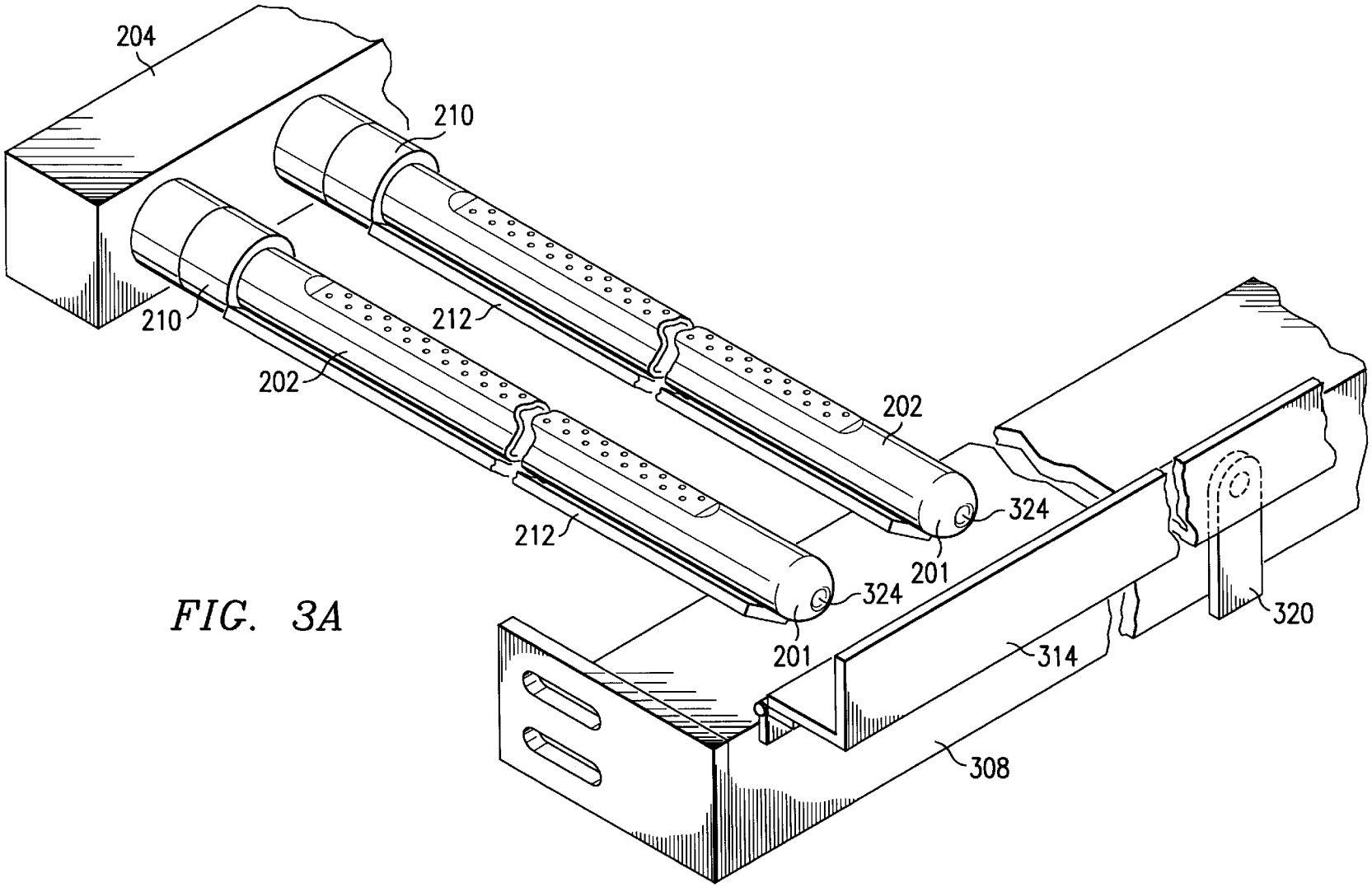
FIGS. 3*a* and 3*b* are partial perspective views of one embodiment of a gate with burner and support installed of the present invention.
Figure 3B:
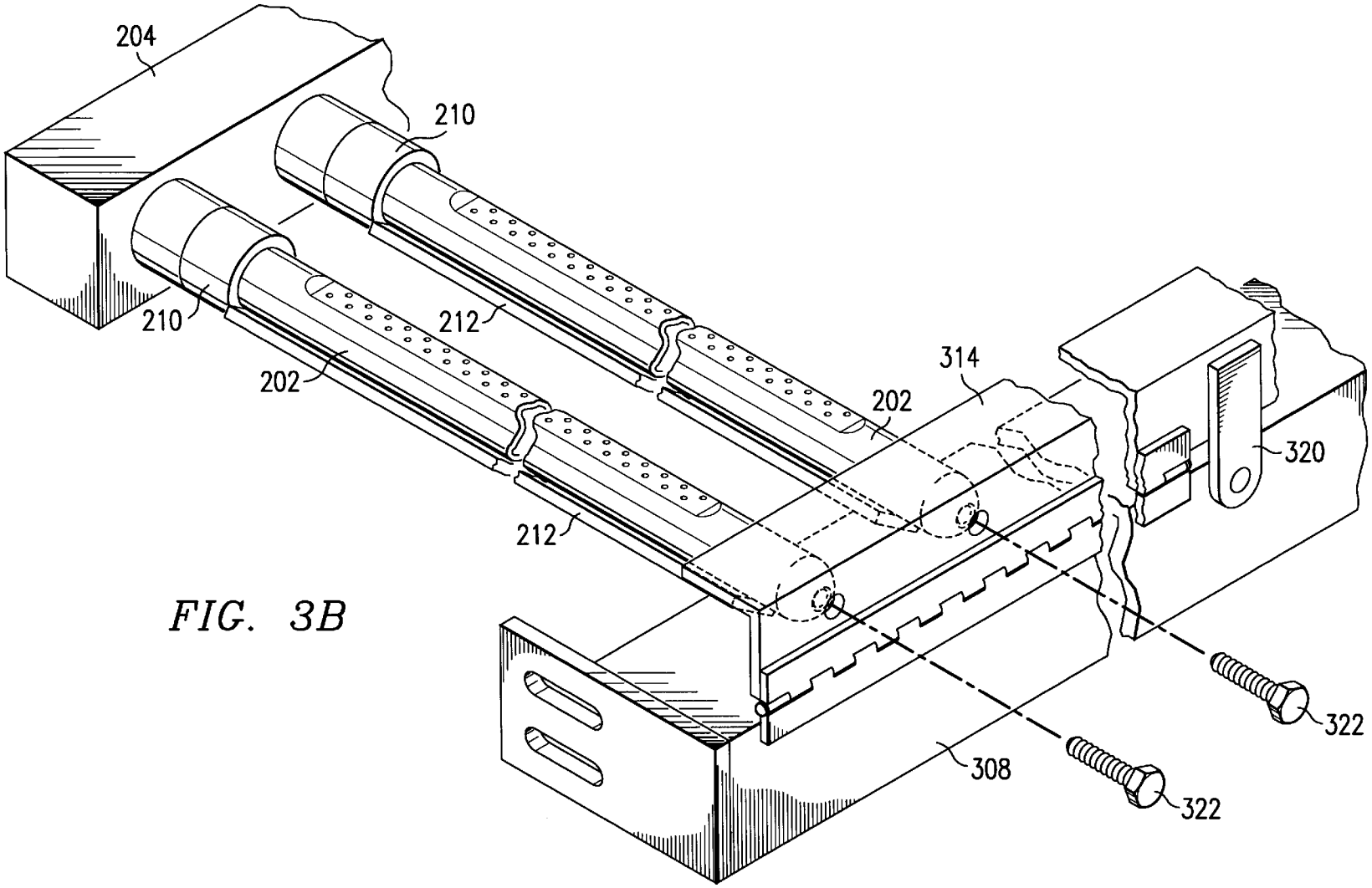

FIGS. 3*a* and 3*b* show partial views of one embodiment of the present invention with two burners 202 installed in their respective sockets 210 and in communication with the gas manifold 204. Corresponding reference numerals are used to represent corresponding elements, unless otherwise indicated. Also shown in FIGS. 3*a* and 3*b* is one embodiment of the burner support 308. The burner support 308 is attached to the chassis of the oven and, in the embodiment illustrated, comprises a gate 314 pivotally attached to the burner support 308. When closed, as shown in FIG. 3*b*, this gate 314 secures the burners 202 in their respective burner guides 212. The gate 314 can then be locked in place by a pivot catch 320 which is pivotally attached to the burner support 308. When the gate 314 is open, as shown in FIG. 3*a*, the oven doors (not shown) cannot be closed. This feature insures that the burner installation process is completed before the oven can be operated.

It is preferred that each burner 202 be fully seated and secured in its respective socket 210 by the application of horizontally directed pressure against the closed end 201 of each burner 202. In the embodiment illustrated in FIGS. 3*a* and 3*b*, this is accomplished by the use of bolts 322 that are tapped through the gate 314. After the gate 314 has been closed and locked by the catch 320, the bolts 322 are tightened until they come into pressure contact with the closed end 201 of an adjacent burner 202. The embodiment illustrated in FIGS. 3*a* and 3*b* further provides for an indentation 324 in the closed end 201 of each burner 202 for receiving a bolt 322. This indentation 324 prohibits lateral movement of the burners 202.

The use of bolts 322 for seating each individual burner 202 is preferred over using a single device, such as the gate 314, for providing horizontally directed pressure against all the burners 202 simultaneously. The individual bolt 322 arrangement accounts for variations in the length of each individual burner 202, as burners tend to distort due to exposure to heat over long periods of time.

Figure 4:
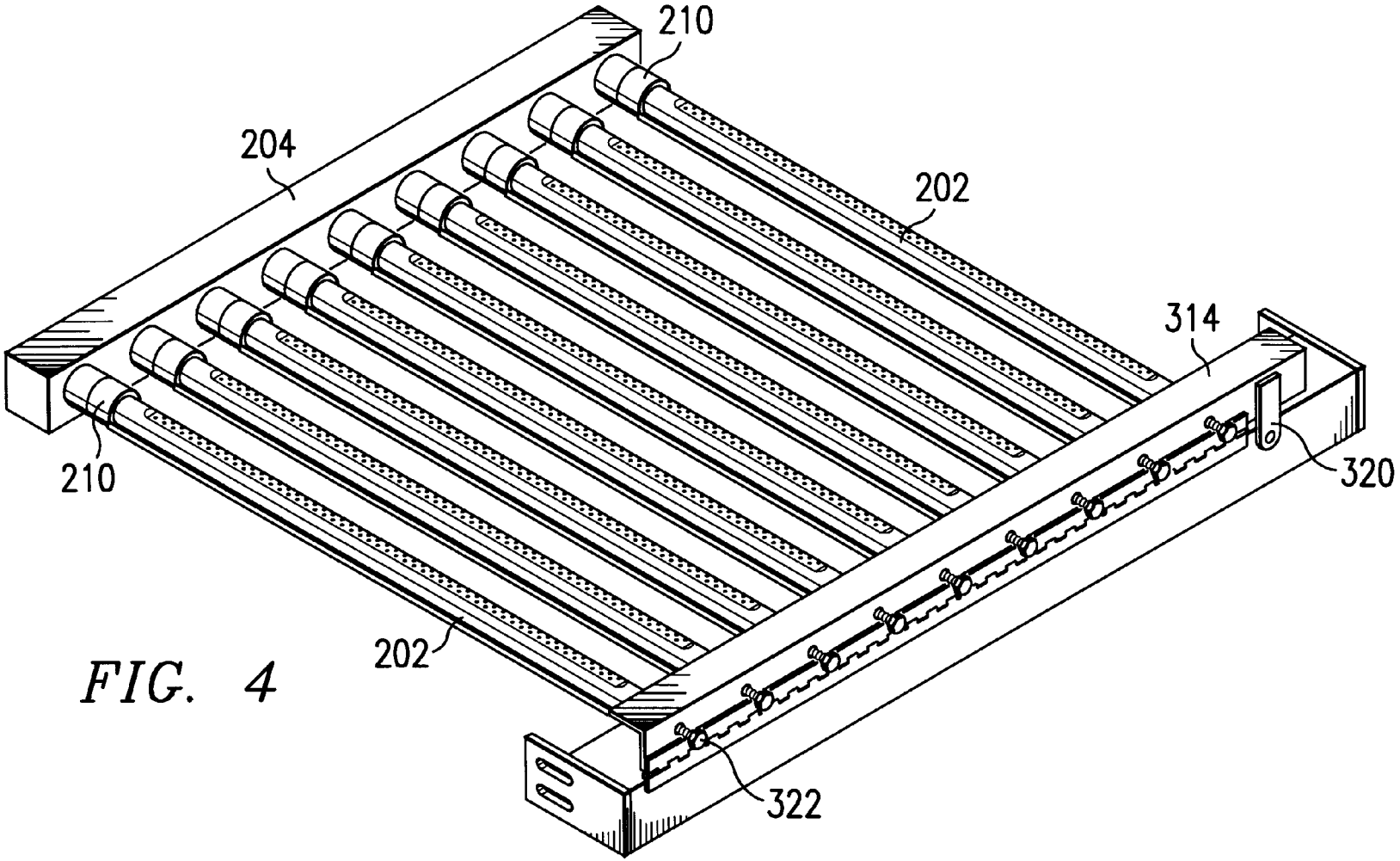
FIG. 4 is a perspective representation of one embodiment of the invention.

FIG. 4 is a perspective view of the one embodiment of the present invention. Nine burners 202 are shown installed in their respective sockets 210 and in communication with the gas manifold 204. The gate 314 is shown in the closed and locked position with the catch 320 in place. Also shown are the respective bolts 322 which seat adjacent burners 202 in receiving sockets 210. It should be understood by those skilled in the art that other securing means could be substituted for the gate 314, the catch 320, and the bolts 322, each one or all having potential equivalent substitutes. For example, a clamping mechanism could be used as a substitute for the gate 314 and catch 320. Receiving channels with set screws might be substituted as a securing means as well. Further, more than one catch 320 could be used to insure that the gate 314 is securely locked in position.

While the invention has been particularly shown and described with reference to a preferred embodiment, it will be understood by those skilled in the art that various changes in form and detail may be made therein without departing from the spirit and scope of the invention.

What is claimed is:

1. A burner set for a commercial oven, said commercial oven having a burner manifold with at least one threaded coupling, said burner set comprising:

at least one socket comprising a threaded end for attaching to a threaded coupling and a receiving end for abutting with a burner;

at least one burner comprising an open end for abutting into said socket and a closed end;

a burner support affixed to said oven; and a gate pivotally attached to the burner support for securing said closed end of said burner.

2. The burner set of claim 1 wherein said at least one socket further comprises a burner guide.

3. The burner set of claim 2 wherein said burner guide comprises a trough for supporting a burner along the length of the burner.

4. The burner set of claim 1 wherein the gate further comprises at least one bolt tapped through said gate for securing a respective burner and wherein the closed end of said burner further comprises an indentation for receiving said bolt.

5. The burner set of claim 1 wherein said gate further comprises at least one catch for locking the gate in a position securing said at least one burner.

6. The burner set of claim 1 wherein said gate prohibits operating said oven while the gate is in an open position.

7. A burner and socket set for adaptation to a commercial oven, said commercial oven having threaded couplings for attaching burners to a gas manifold, said burner and socket set comprising:

a socket having a threaded end for securing to a threaded coupling and having a receiving end for abutting with a burner;

a burner having an open end for abutting in said socket and having a closed end; and, a burner guide attached to the receiving end of said socket for providing horizontal support to a burner abutted with the socket, wherein said burner guide extends from said socket parallel to said burner and towards the closed end of said burner.

8. The burner and socket set of claim 7 further comprising:

a means for securing the closed end of said burner to the oven, said means operable in a closed position and an open position, wherein said closed end of said burner is secured to the oven when said means is in a closed position and removable when said means is in an open position.

9. The burner and socket set of claim 8 wherein said means for securing the closed end of said burner to the oven comprises an angled gate pivotally attached to a burner support.

10. The burner and socket set of claim 9 wherein said means for securing the closed end of said burner to the oven further comprises a pivot catch attached to said burner support for locking said angled gate in place over the closed end of said burner.

11. The burner and socket set of claim 9 wherein said gate prohibits the operation of the oven when in an open position.

12. The burner and socket set of claim 9 wherein the angled gate further comprises a plurality of bolts tapped through said gate and positioned to mate with the closed ends of adjacent burners secured by said gate.

13. The burner and socket set of claim 12 wherein the closed end of each of said adjacent burners further comprises an indentation for receiving a bolt.

14. A method for adapting a commercial oven for use with quick-change burners, said commercial oven having a burner support bracket and a plurality of threaded couplings in communication with a gas manifold, said method comprising the steps of:

a) removing the burner support bracket;

b) installing a burner support with a pivotally attached gate in place of the burner support bracket; and c) installing a plurality of quick-change sockets in each threaded coupling, said quick-change sockets comprising:

a threaded end for insertion into a threaded coupling;

an open end for receiving a burner; and a burner guide attached to said open end.

15. The method of claim 14 further comprising the steps of:

d) abutting a burner in the open end of each quick-change socket; and e) securing each burner with the pivotally attached gate.

16. The method of claim 15 further comprising the steps of:

f) locking said gate in place with at least one pivot catch attached to the installed burner support.

17. The method of claim 16 further comprising the steps of:

g) pressure seating each burner in a respective quick-change socket.

18. The method of claim 17 wherein step g) is accomplished by tightening against the closed end of each burner adjacent bolts tapped through the gate.

* * * * *